US006604628B1

(12) United States Patent
Tanaka et al.

(10) Patent No.: US 6,604,628 B1
(45) Date of Patent: Aug. 12, 2003

(54) WET TISSUE CONTAINER AND COMBINATION THEREOF

(75) Inventors: Yoshikazu Tanaka, Kagawa-Ken (JP); Takeshi Bando, Kagawa-Ken (JP); Hiroki Ishikawa, Kagawa-Ken (JP); Emiko Inoue, Kagawa-Ken (JP); Masaho Hayashi, Tokyo-To (JP); Hiroshi Uematsu, Tokyo-To (JP); Norikazu Shinogi, Tokyo-To (JP); Toshihiko Uenishi, Tokyo-To (JP)

(73) Assignee: Uni-Charm Corporation (JP)

( * ) Notice: Subject to any disclaimer, the term of this patent is extended or adjusted under 35 U.S.C. 154(b) by 0 days.

(21) Appl. No.: 09/831,114

(22) PCT Filed: Sep. 4, 2000

(86) PCT No.: PCT/JP00/05998

§ 371 (c)(1),
(2), (4) Date: May 4, 2001

(87) PCT Pub. No.: WO01/17412

PCT Pub. Date: Mar. 15, 2001

(30) Foreign Application Priority Data

Sep. 6, 1999 (JP) ..... 11-251840
Mar. 10, 2000 (JP) ..... 2000-066771

(51) Int. Cl.[7] ..... B65D 83/00

(52) U.S. Cl. ..... 206/209; 206/207; 206/233; 206/812; 220/481; 248/311.2

(58) Field of Search ..... 206/233, 494, 206/812, 207, 209; 220/476–483; 221/45, 46, 48, 61, 63; 248/205.3, 213.1, 213.2, 220.21, 220.22, 221.11, 224.7, 224.8, 225.11, 225.21, 222.41, 223.21, 307, 311.2

(56) References Cited

U.S. PATENT DOCUMENTS

| | | | | | |
|---|---|---|---|---|---|
| 1,430,709 | A | * | 10/1922 | Wheeler | 221/48 |
| 3,207,566 | A | * | 9/1965 | Grieco et al. | 248/205.3 |
| 3,285,559 | A | * | 11/1966 | Simon | 221/46 |
| 3,514,014 | A | * | 5/1970 | Skowronski | 221/46 |
| 3,982,659 | A | * | 9/1976 | Ross | 221/63 |
| 3,986,479 | A | * | 10/1976 | Bonk | 221/63 |
| 4,004,687 | A | * | 1/1977 | Boone | 206/812 |
| 4,106,617 | A | * | 8/1978 | Boone | 206/812 |
| 4,235,333 | A | * | 11/1980 | Boone | 206/233 |
| 4,535,912 | A | * | 8/1985 | Bonk | 221/46 |
| 4,735,317 | A | * | 4/1988 | Sussman et al. | 206/494 |
| 4,978,095 | A | * | 12/1990 | Phillips | 206/233 |
| 5,311,986 | A | | 5/1994 | Putz | 206/233 |
| 5,897,074 | A | | 4/1999 | Marino | 242/594.1 |

FOREIGN PATENT DOCUMENTS

| | | |
|---|---|---|
| GB | 2 113 655 A | 8/1993 |
| JP | 60-185998 | 12/1985 |
| JP | 61-31291 | 2/1986 |
| JP | 4-12997 | 2/1992 |
| JP | 11-180460 | 7/1999 |
| WO | 99-19227 | 4/1999 |

* cited by examiner

*Primary Examiner*—Jim Foster
(74) *Attorney, Agent, or Firm*—Parkhurst & Wendel, L.L.P.

(57) ABSTRACT

A wet tissue container (10) includes a container body (11), a lid (23) supported for turning on the container body (11) and a bottom wall (12) hermetically closing the open lower end of the container body (11). A rubber plate (50) is extended between the container body (11) and the lid (23). The wet tissue container (10) is held by a container holder (1). The container holder (1) has a back part (2) on which the bottom wall (12) is seated, guide parts (3, 4) of an L-shaped cross section that engage edge parts (**12*a*, 12*b*) of the bottom wall (12) and edge parts (14*a*, 14*b*) of a flange (14) formed on the container body (11). A support part (5) to be inserted in a slot formed in a toilet paper holder (7) is connected to the back part (2**).

16 Claims, 16 Drawing Sheets

WET TISSUE CONTAINER AND COMBINATION THEREOF

TECHNICAL FIELD

The present invention relates to a wet tissue container and a wet tissue dispenser, i.e., a combination of the wet tissue container and a container holder.

BACKGROUND ART

A wet tissue container containing wet tissues has an opening through which wet tissues are taken out, and the opening is closed hermetically by a removable lid.

Such a conventional wet tissue container has a container body containing wet tissues and provided with an opening, and a lid hermetically closing the opening of the container body.

When using the wet tissues contained in the wet tissue container, the lid is opened and the tissues are taken out one by one through the opening of the container body.

As mentioned above, the conventional wet tissue container has the container body and the lid supported for turning on the container body. When using the wet tissues contained in the wet tissue container, the lid is turned open and the wet tissues are taken out of the container body through the opening.

Incidentally, wet tissues made of a water-soluble material have been developed in recent years. Such wet tissues are used in a toilet room and the used wet tissues can be thrown into a toilet bowl for disposal. It is convenient if the wet tissue container can be attached to a toilet paper holder placed in the toilet room.

DISCLOSURE OF THE INVENTION

The present invention has been made in view of such circumstances and it is therefore an object of the present invention to provide a wet tissue container that can be easily held on a holder in a toilet room or the like, and a combination of a wet tissue container and a container holder.

According to the present invention, a combination of a wet tissue container and a container holder capable of holding the wet tissue container on a fixed structure in a room is provided.

According to the present invention, a wet tissue container is provided with a fastening means for fastening the wet tissue container to a fixed structure in a room.

According to the present invention, the wet tissue container can be easily attached to a fixed structure in, for example, a toilet room by fixing the container holder to the fixed structure.

The wet tissue container can be easily attached to a fixed structure in, for example, a toilet room.

BEST MODE FOR CARRYING OUT THE INVENTION

First Embodiment

Preferred embodiments of the present invention will be described with reference to the accompanying drawings. FIGS. 1 to 6 show a first embodiment of the present invention.

Figure 3:
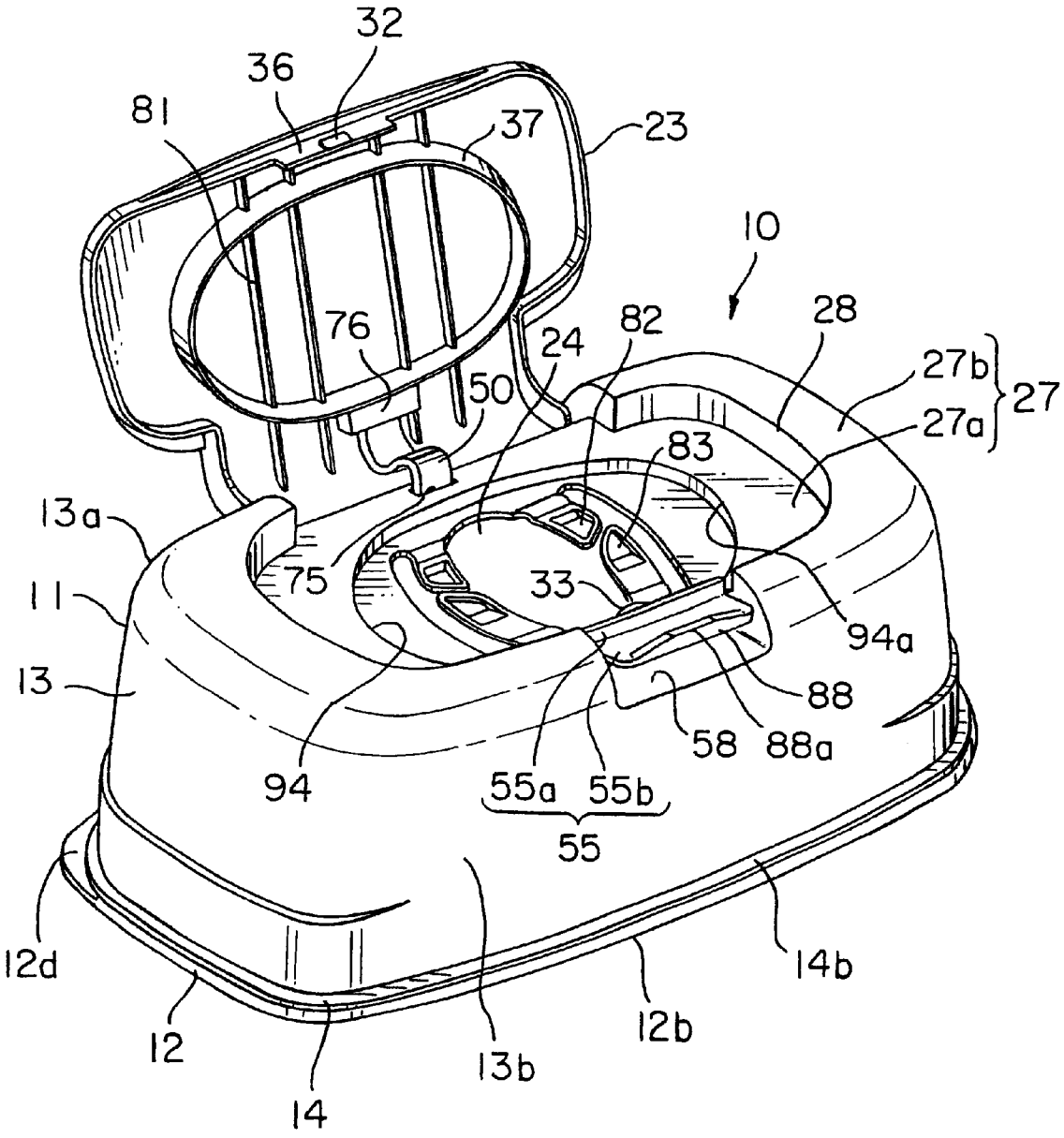
FIG. 3 is a perspective view showing the wet tissue container shown in FIG. 2.

A wet tissue container (container with a lid) 10 will be described with reference to FIG. 3. Referring to FIG. 3, the container with a lid 10*a* has a container body 11 with an open lower end for containing wet tissues 41 (FIG. 4), and a bottom wall 12 hermetically closing the open lower end of the container body 11. The container body 11 has a top wall 27 provided with an opening 24, and a side wall 13 extending down from the top wall 27. A lid 23 for hermetically closing the opening 24 of the top plate 27 is supported for turning on the side wall 13 of the container body 11.

A flange 14 is formed around the lower end of the side wall 13. The bottom wall 12 is joined to the flange 14. The bottom wall 12 has a projecting part 12*d*, i.e., a finger tab, projecting outside the periphery of the side wall 13. A pair of opposite side parts 13*a* and 13*b* of the side wall 13 are bulged convexly.

The top wall 27 of the container body 11 has a first top part (first thin part) 27*a* forming a substantially central part of the top wall 27, an upright part 28 rising from the periphery of the first top part 27*a*, and a second top part (second thin part) 27*b* extending from the upper end of the upright part 28 on a level above that of the first top part 27*a*. The opening 24 through which wet tissues 41 are taken out, is formed in the first top part 27*a*.

The first top part 27*a* is provided with a vertical annular wall 94. The opening 24 is formed in a part of the first top part 27*a* inside the annular wall 94. An annular rib 37 that can be fitted by the annular wall 94 is, formed on the inner surface of the lid 23. The lid 23 is turned so that the annular rib 37 is fitted in the space surrounded by the annular wall 94 to close the opening 24 hermetically. Reinforcing ribs 81 are formed on the inner surface of the lid 23.

As shown in FIG. 3, the lid 23 is provided on its free end part with a side rib 36. A stopping projection 32 is formed integrally with the side rib 36.

An upper end part of the side wall 13 on the side of the free end part of the lid 23 is recessed to form a recessed step 58 recessed from the top wall 27. A vertical wall 55*a* is provided on the recessed step 58. A horizontal wall 55*b* projects forward from the upper end of the vertical wall 55*a*. A catching projection 33 is formed on the inner surface of the vertical wall 55*a*. The stopping projection 32 of the lid 23 can be engaged with the catching projection 33. The vertical wall 55*a* and the horizontal wall 55*b* constitute an operating member 55 for opening the lid 23.

A rubber plate 50 is extended between the container body 11 and the lid 23 to bias the lid 23 in an opening direction. The rubber plate 50 has one end inserted in a slot 75 formed in the container body 11, and the other end fastened to a holding part 76 formed on the lid 23 and spaced a predetermined distance apart from the container body 11.

The container body 11 and the lid 23 are formed of a polypropylene resin (PP) by injection molding. The container body 11 and the lid 23 may be formed of any one of PE resins, PS resins, ABS resins, elastomers, PET resins, PVC resins and polycarbonate resins. Preferably, the bottom wall 12 is formed of a linear, low-density polyethylene resin (LLDPE). The rubber plate 50 is formed of silicone rubber. The holding part 76 is formed of a PP resin.

The operating member 55 included in the container body 11 will be described. As shown in FIG. 3, a finger tab 88 is formed by bending a free end part of the horizontal wall 55*b* upward. The horizontal wall 55*b* can be easily moved down by depressing the finger tab 88 by a finger. The finger tab 88 is formed in an upward convex shape to facilitate putting a finger on the finger tab 88.

As shown in FIG. 3, the top wall 27 of the container body 11 is provided with the annular wall 94 having an inner surface that engages the annular rib 37 of the lid 23. The upper edge of the annular wall 94 is chamfered to form a bevel surface 94*a* to enable the lid 23 to be easily opened even if a wet tissue 41 is caught between the annular rib 37 and the annular wall 94. The bevel surface 94*a* is formed in the entire upper edge of the annular wall 94 excluding a section corresponding to the rubber plate 50. The biasing force of the rubber plate 50 acting on a part of the annular rib 37 in the vicinity of the rubber plate 50 is high and hence the part of the upper edge of the annular wall 94 corresponding to the rubber plate 50 does not need to be chamfered and the annular rib 37 and the annular wall 94 are in close engagement.

A structure forming the opening 24 of the top plate 27 of the container body 11 will be described. The first top part 27*a* of the top wall 27 is provided with a pair of first flaps 82 extending into the opening 24, and a pair of second flaps 83 extending into the opening 24. The pair of first flaps 82 and the pair of second flaps 83 are disposed opposite to each other.

Each of the pair of first flaps 82 and the pair of second flaps 83 has a wavy sectional shape extending from the base end toward the free end thereof. Thus, bending directions of the pair of first flaps 82 and the pair of second flaps 83 perpendicular to directions along the lengths of the flaps 82 and 83 are determined, so that the flaps 82 and 83 can be stably and surely bent.

The pair of first flaps 82 are extended away from each other to expand a space between the pair of first flaps 82 toward the extremities of the pair of first flaps 82, and the pair of second flaps 83 extend away from each other to expand a space between the pair of second flaps 83 toward the extremities of the pair of second flaps 83.

Figure 4:
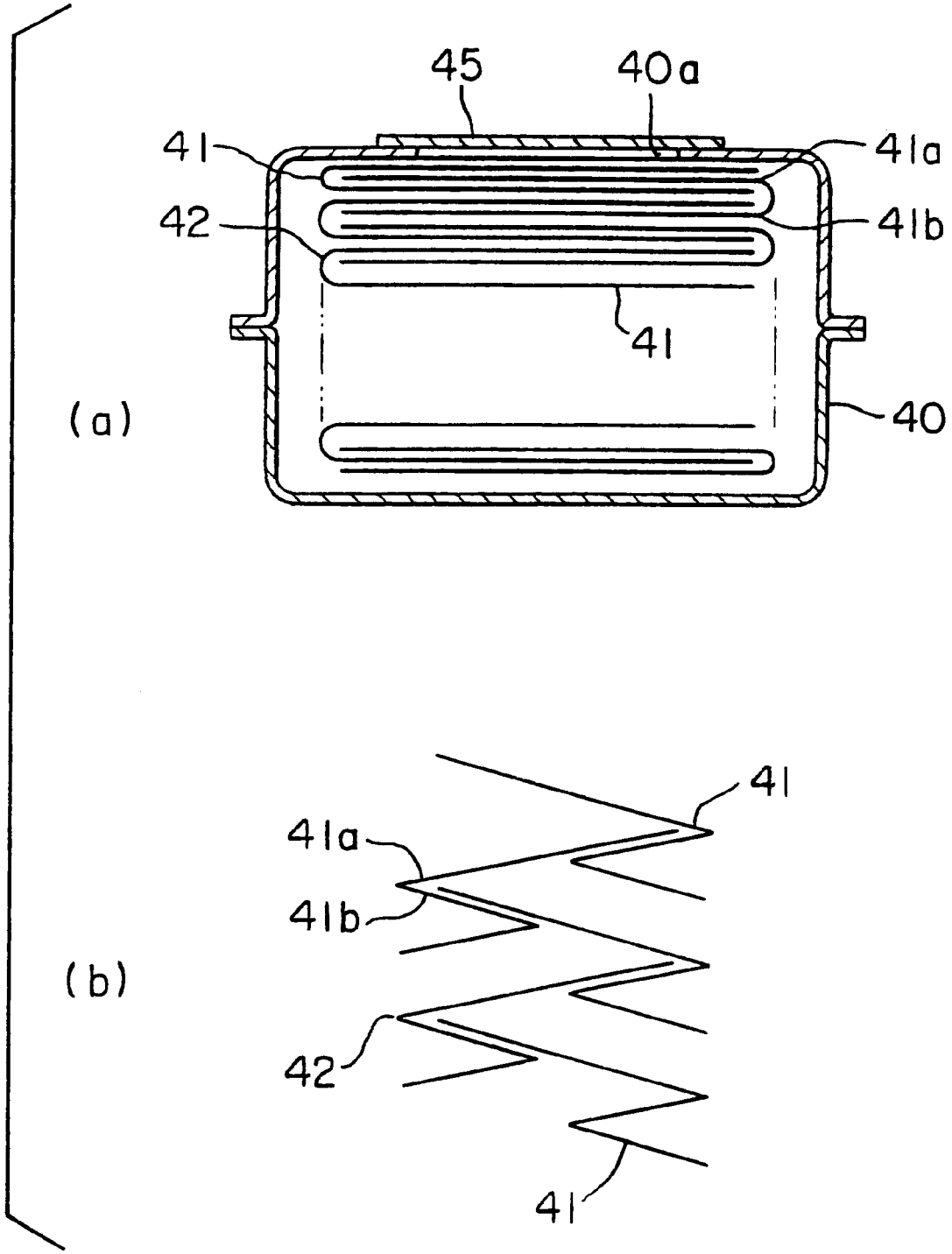
FIG. 4 is a sectional view showing a sealed pouch containing wet tissues.
Figure 5:
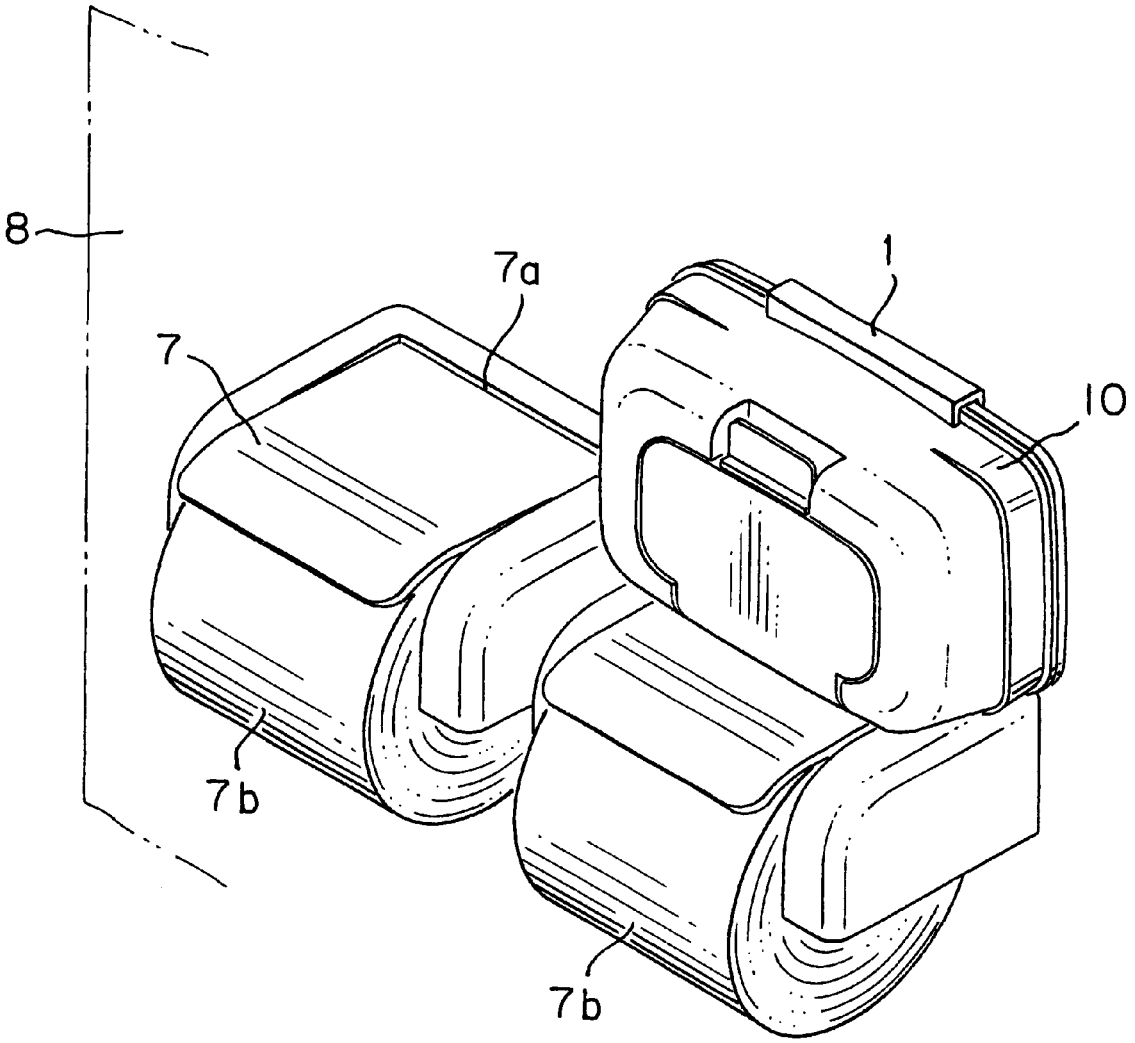
FIG. 5 is a perspective view showing the wet tissue container shown in FIG. 2 attached to a toilet paper holder.

The wet tissues 41 contained in the container body 11 will be described with reference to FIG. 4. Referring to FIG. 4(*a*), the folded wet tissues 41 are piled up in a neat pile and the neat pile of the wet tissues 41 is sealed in a sealed pouch 40 formed from a soft film. Each wet tissue 41 is folded substantially in two along a fold 42. Folded wet tissues 41 respectively having folds 42 on the opposite sides are piled alternately. The lower half 41*b* of a first folded wet tissue 41 lies between the upper half 41*b* of a second folded wet tissue 41 underlying the first folded wet tissue 41 and the upper half 41*a* of a third wet tissue 41 underlying the second folded wet tissue 41. When the top wet tissue 41 is pulled out of the sealed pouch 40, the lower half 41*b* of the same wet tissue 41 pulls up the upper half 41*a* of the second top wet tissue 41. There is no particular restriction on the method of folding the wet tissues 41 and the wet tissues 41 may be folded by any folding method, provided that the wet tissues 41 can be successively taken out of the sealed pouch 40. For example, the wet tissues 41 may be folded and piled up as shown in FIG. 4(*b*). An opening 40*a* is formed in the upper wall of the sealed pouch 40 and the opening 40*a* is covered with a removable seal 45 attached to the upper wall of the sealed pouch 40.

The wet tissues 41 are formed of a water-soluble material. The wet tissues 41 may be formed of paper or may be sheets of a textile material, such as gauze or nonwoven fabric, foamed material or a paper-base soft material. A liquid with which the tissues are impregnated to provide the wet tissues 41 may be any one of wetting agents respectively containing germicides, disinfectants and detergents, and cosmetics including lotions and milky lotions.

A description will be given of a container holder 1 for holding the container with a lid 10 on a toilet paper holder attached to a fixed structure in a toilet room.

Referring to FIGS. 1 to 6, the container holder 1 has a tack part 2 having the shape of a flat plate on which the bottom wall 12 of the container with a lid 10 is set, a pair guide parts 3 and 4 having an L-shaped cross section, and a support part 5 to be inserted in a slot 7*a* formed in a toilet paper holder 7. Opposite side edge parts 12*a* and 12*b* of the bottom wall 12 and the opposite side edge parts 14*a* and 14*b* of the flange 14 of the container body 11 engage the guide parts 3 and 4, respectively.

The back part 2 and the pair of guide parts 3 and 4 having an L-shaped cross section form a holding structure for holding the bottom wall 12 of the container with a lid 10 and the flange 14 of the container body 11.

Figure 1:
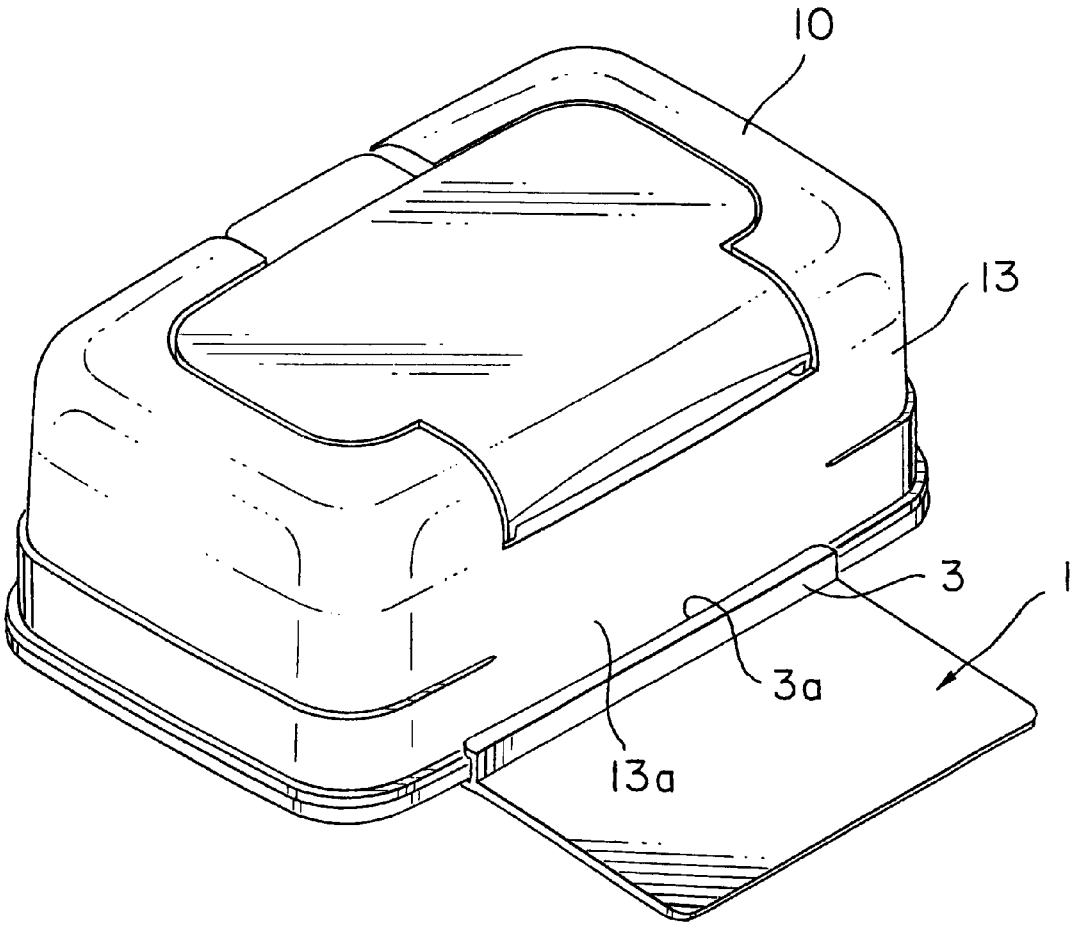
FIG. 1 is a perspective view showing a wet tissue dispenser, i.e., a combination of a wet tissue container and a container holder, in a first embodiment according to the present invention.
Figure 2:
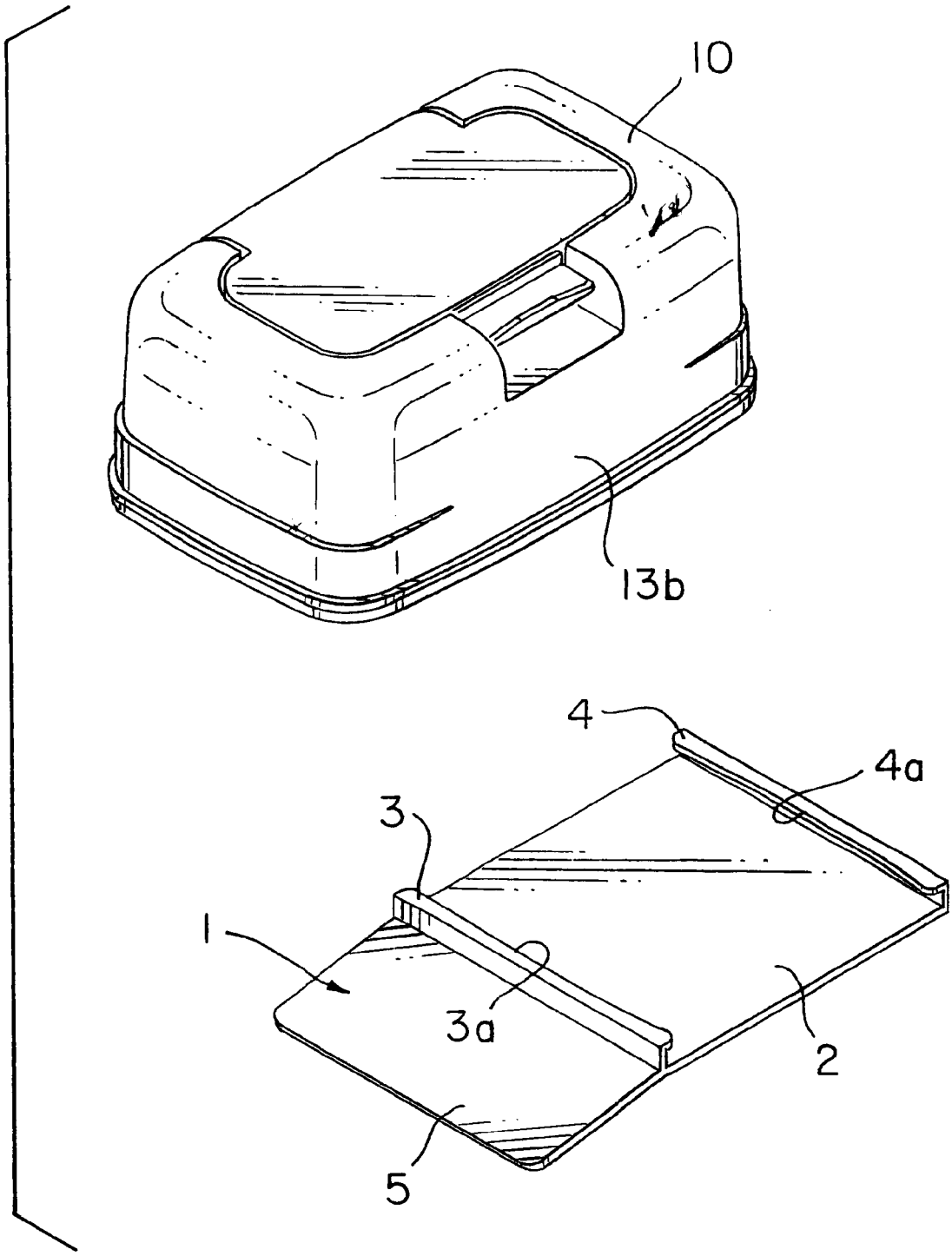
FIG. 2 is a perspective view showing a container holder and a wet tissue container separated from the container holder of the wet tissue dispenser shown in FIG. 1.
Figure 6:
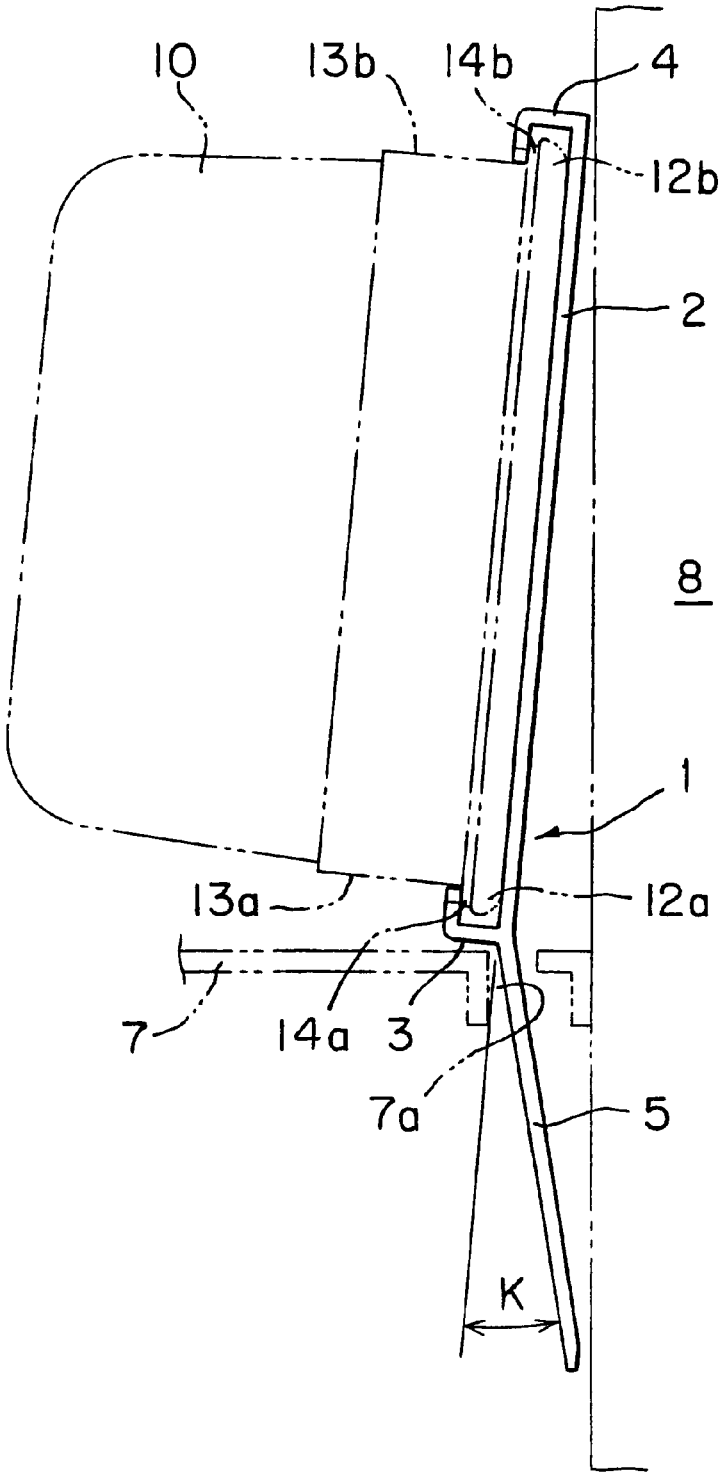
FIG. 6 is a sectional view showing the container holder.
Figure 7:
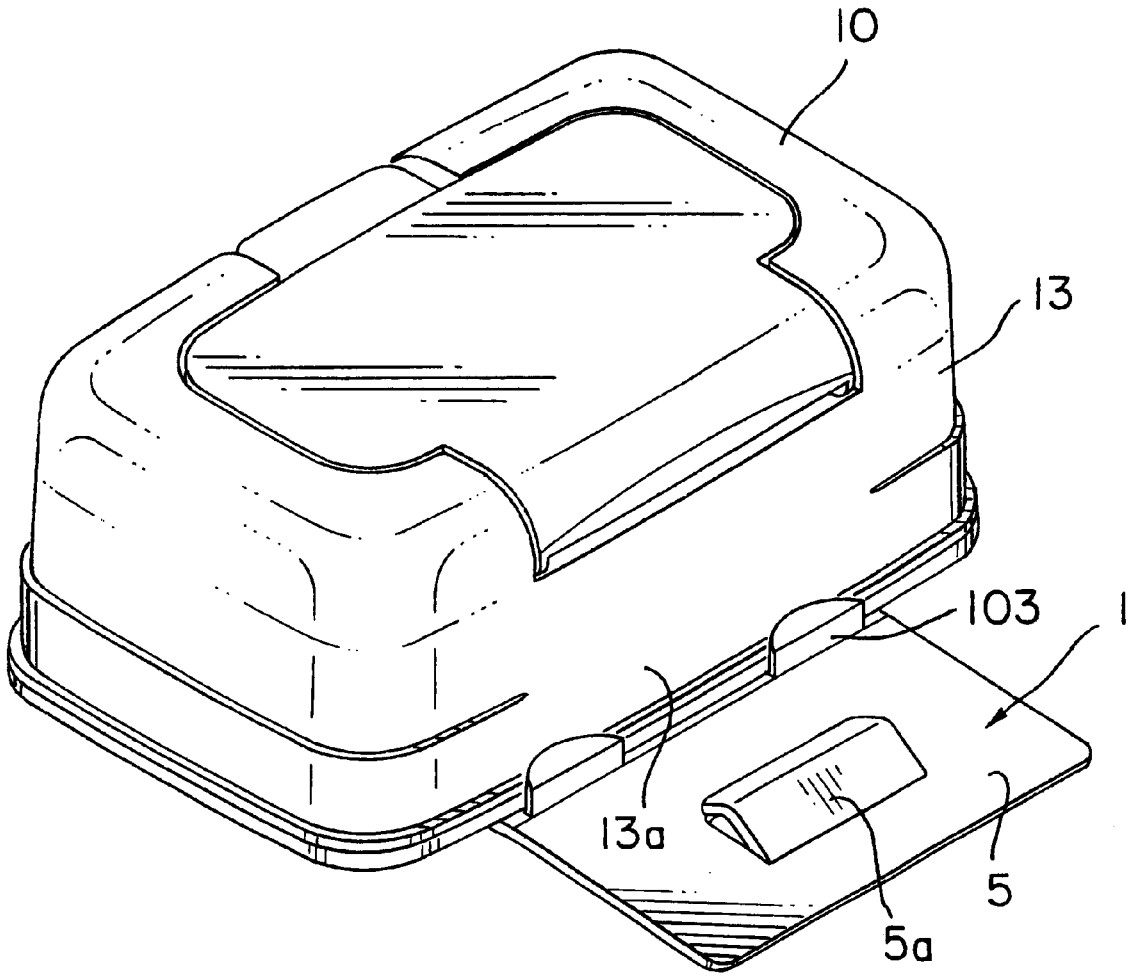
FIG. 7 is a perspective view showing a wet tissue dispenser, i.e., a combination of a set tissue container and a container holder, in a second embodiment according to the present invention.

The guide member having an L-shaped cross section will be described. Referring to FIGS. 2 and 6, the guide parts 3 and 4 hold the opposite side edge parts 12*a* and 12*b* of the bottom wall 12 and the opposite side edge parts 14*a* and 14*b* of the flange 14 of the container body 11, respectively. The opposite side edge parts 12*a* and 12*b* of the bottom wall 12 and the opposite side edge parts 14*a* and 14*b* of the flange 14 of the container body 11 extend outward from the pair of side parts 13*a* and 13*b* of the container with a lid 10, respectively.

The convex side parts 13*a* and 13*b* of the side wall 13 are in contact with the edges of the guide parts 3 and 4.

Sections 3*a* and 4*a* of the edges of the guide parts 3 and 4 in contact with the convex side parts 13*a* and 13*b* are curved concavely. The container with a lid 10 can be easily positioned on the container holder 1 by sliding the container with a lid 10 along the guide parts 3 and 4 of the container holder 1 so that the pair of convex side parts 13*a* and 13*b* of the side wall 13 engage the concave sections 3*a* and 4*a* of the guide parts 3 and 4, respectively.

As shown in FIG. 6, the support part 5 of the container holder 1 is inclined at an angle K to the back part 5 so as to extend away from a plane including the surface of the back part 5. Preferably, the angle K is in the range of 5° to 20°. In this embodiment shown in FIG. 6, K=15°.

Generally, the toilet paper holder 7 holds a toilet paper roll 7*b* and is fastened to a wall 8 of the toilet room. Since the support part 5 of the container holder 1 is inclined to the back part 2 of the same, the surface of the back part 2 is inclined to the wall 8, when the support part 5 is inserted in the slot 7*a* formed in the toilet paper holder 7 as shown in FIG. 6. Thus, the container with a lid 10 can be securely held by the container holder 1 having the back part 2 and the guide parts 3 and 4 on the wall 8 in an in an inclined position.

Operation of the first embodiment thus formed will be described hereinafter.

When holding the container with a lid 10 by the container holder 1, the opposite side edge parts 12*a* and 12*b* of the bottom wall 12 and the opposite side edge parts 14*a* and 14*b* of the flange 14 of the container body 11 are inserted in a space between the guide parts 3 and 4 of the container holder 1 so that the opposite side edge parts 12*a* and 12*b* of the bottom wall 12 and the opposite side edge parts 14*a* and 14*b* of the flange 14 of the container body 11 engage the guide parts 3 and 4, respectively. The container with a lid 10 can be easily positioned on the container holder 1 by sliding the container with a lid 10 along the guide parts 3 and 4 of the container holder 1 so that the pair of convex side parts 13*a* and 13*b* of the side wall 13 engage the concave sections 3*a* and 4*a* of the guide parts 3 and 4, respectively.

Then, the support part 5 of the container holder 1 is inserted in, for example, the slot 7*a* of the toilet paper holder 7 to hold the container with a lid 10 securely on the toilet paper holder 7.

When using the wet tissues 41, the finger tab 88 of the horizontal wall 55*b* of the operating member 55 is depressed to disengage the stopping projection 32 and the catching projection 33. Then, the lid 23 is opened by the resilience force of the rubber plate 50.

The top wet tissue 41 is picked up between fingers and is pulled up. Then the wet tissue 41 is pulled out of the container body 11. When the top wet tissue 41 is thus pulled out of the container body 11, the lower half 41*b* of the top wet tissue 41 pulls the upper half 41*a* of the second top wet tissue 41 into the gap between the end edges of the first flaps 82 and those of the second flaps 83. After the top wet tissue 41 has been taken out, the upper half 41*a* of the second top wet tissue 41 is held between the first flaps 82 and the second flaps 83.

Thus the container with a lid 10 can be easily held on the wall of the toilet room by holding the container with a lid 10 by the container holder 1 and inserting the support part 5 in the slot 7*a* of the toilet paper holder 7. The lid 23 can be easily opened simply by depressing the finger tab 88 and the wet tissue 41 can be pulled out of the container with a lid 10 through the opening 24.

Thus, according to the present invention, the container with a lid can be easily held by the toilet paper holder in the toilet room. The lid can be easily opened and the contents of the container with a lid can be easily taken out.

Second Embodiment

A wet tissue dispenser in a second embodiment according to the present invention will be described hereinafter. FIGS. 7 to 10 show a wet tissue dispenser, i.e., a combination of a container with a lid and a container holder.

A wet tissue container (container with a lid) 10 is held by a container holder 1 on a toilet paper holder placed in a toilet room. The container holder 1 will be described.

Referring to FIGS. 7, 8, 9 and 10, the container holder 1 has a back part 2 having the shape of a flat plate on which a bottom wall 12 included in the container with a lid 10 is set, a pair first guide parts 103 formed on and connected axially to the back part 2 so as to be in contact with one side edge part 12*a* of the bottom wall 12 and one edge part 14*a* of a flange 14 formed on a container body 11, a pair of second guide parts 104 formed on the back part 2 so as to be in contact with the other side edge part 12*b* of the bottom wall 12 and the other edge part 14*b* of the flange 14, and a support part 5 extended from the back part 2. The first guide parts 103 and the second guide parts 104 are formed on the opposite sides of the back part 2, respectively. The support part 5 is inserted in a slot 7*a* formed in a toilet paper holder 7.

The back part 2, the first guide parts 103 and the second guide parts 104 form a holding structure for holding the bottom wall 12 of the container with a lid 10 and the flange 14 of the container body 11.

Figure 10:
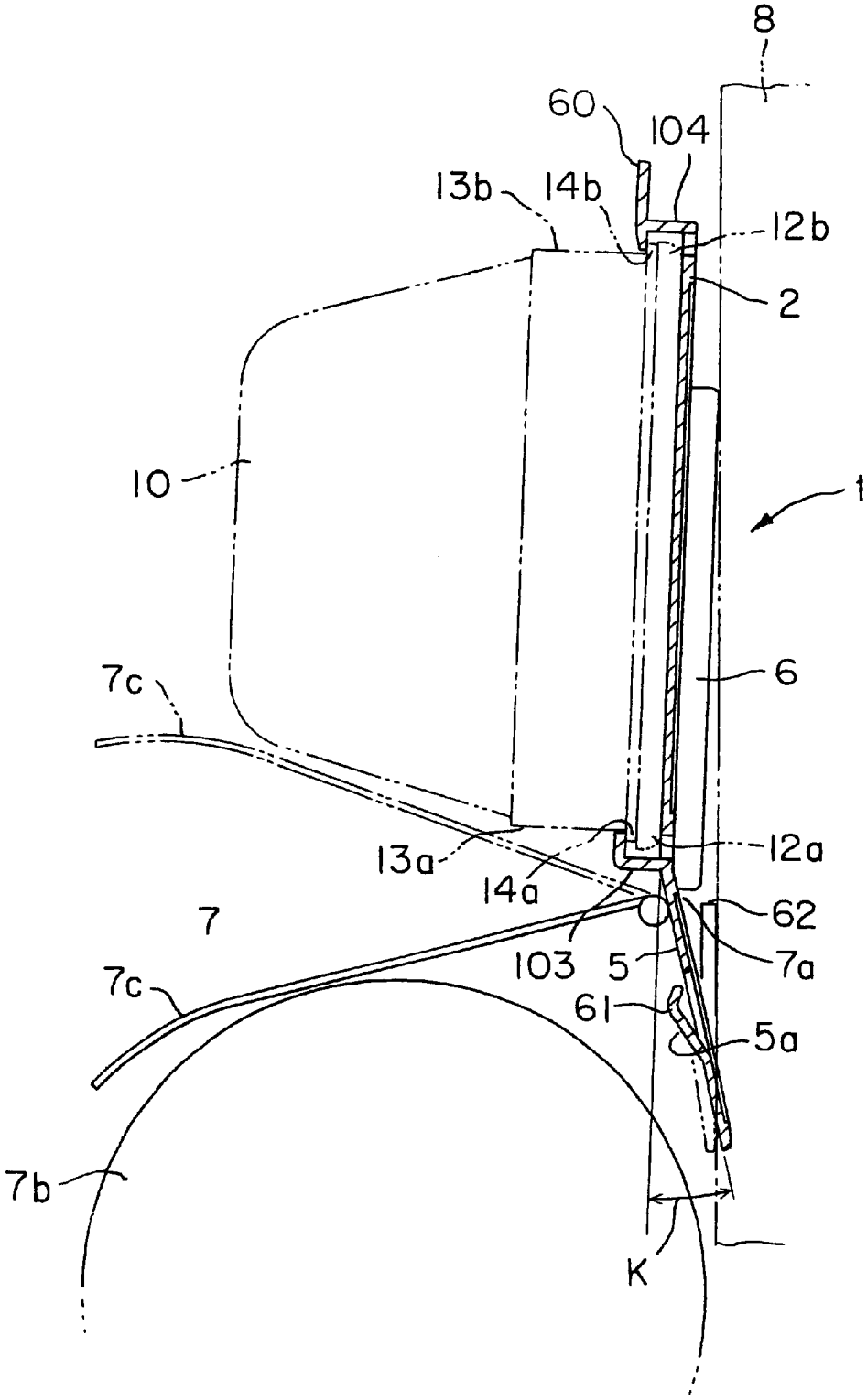
FIG. 10 is a sectional view showing the container holder shown in FIG. 7.

The first guide parts 103 and the second guide parts 104 will be described. Referring to FIG. 10, the first guide parts 103 and the second guide parts 104 have an L-shaped cross section. The opposite edge parts 12*a* and 12*b* of the bottom wall 12 and the opposite edge parts 14*a* and 14*b* of the flange 14 of the container body 11 engage the first guide parts 103 and the second guide parts 104. The edge parts 12*a* and 12*b* of the bottom wall 12 and the edge parts 14*a* and 14*b* of the flange 14 of the container body 11 extend outside the opposite side parts 13*a* and 13*b* of a side wall 13 included in the container with a lid 10.

The pair of opposite side parts 13*a* and 13*b* of the side wall 13 are bulged convexly. The convex side parts 13*a* and 13*b* of the side wall 13 are in contact with the first guide parts 103 and the second guide parts 104, respectively. Thus, the container body 11 can be surely positioned on the back part 2.

In this embodiment, an operating plate 60 is formed integrally with the second guide parts 104 so as to extend away from the container with a lid 10 held on the container holder 1. When the operating plate 60 is pushed, the second guide parts 104 are bent away from the container with a lid 10 to disengage the second guide parts 104 from the edge parts 12*b* and 14*b*.

The container holder 1 is formed of a soft resin. Therefore, the second guide parts 104 can be easily bent by pushing the operating plate 60. The operating plate 60 may be omitted and force may be exerted directly on the second guide parts 104 of the soft resin to bend the second guide parts 104.

Figure 8:
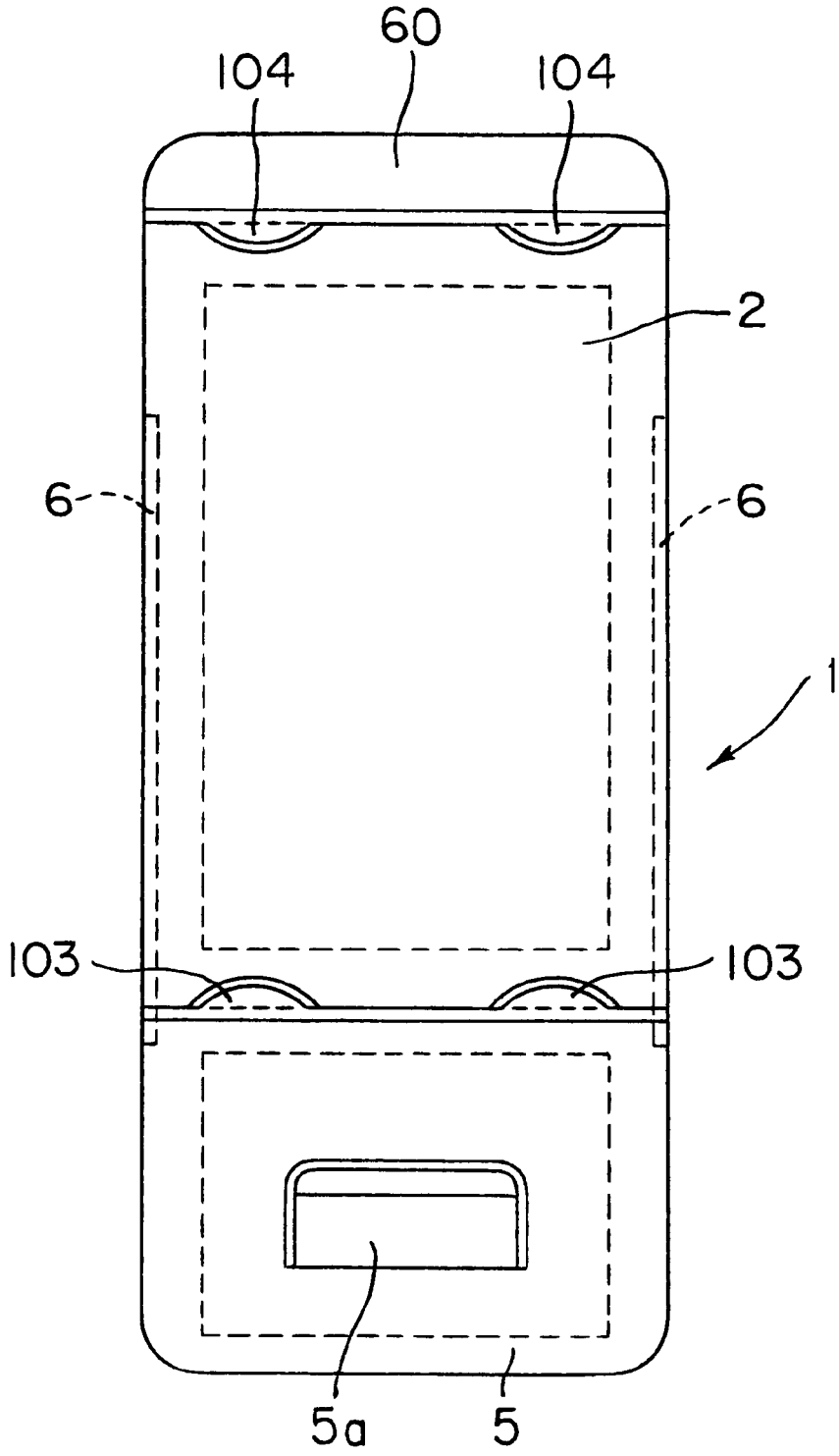
FIG. 8 is front elevation showing the container holder shown in FIG. 7.

Referring to FIGS. 8 and 10, the support part 5 has a stopping part 5*a* formed by raising a part thereof in the shape of a roof. The free end part 61 of the stopping part 5*a* engages the lower end (lower surface of a brim 62) of a part provided with the slot 7*a* of the toilet paper holder 7, so that the support part 5 cannot be easily pulled off the toilet paper holder 7 when the container holder 1 is pulled quickly. When the container holder 1 is pulled slowly away from the toilet paper holder 7, the stopping part 5*a* yields to lower the free end part 61 and the support part 5 can be pulled out of the toilet paper holder 7.

A pair of stopper ribs 6 are formed on the back surface of the back part 2 opposite the front surface on which the first guide parts 103 and the second guide parts 104 are formed. The lower ends of the stopper ribs 6 rest on the upper surface of the brim 62 of the slot 7*a* of the toilet paper holder 7 to prevent the container holder 1 from dropping and to reinforce the back part 2.

The stopper ribs 6 extends from a level below the first guide parts 103 to a level below the second guide parts 104. Therefore, the first guide parts 103 are held firmly, while the second guide parts 104 are able to bend.

The container holder 1 can be held in place on the toilet paper holder 7 with the stopper ribs 6 resting on the upper surface of the brim 62 of the slot 7*a*. In this state, a space wide enough to permit a cover 7*c* covering a toilet paper roll 7*b* held on the toilet paper holder 7 to swing for toilet paper roll replacement is formed between the container with a lid 10 held on the container holder 1 and the cover 7*c*. Therefore, the cover 7*c* can be turned in a necessary angular range without removing the container holder 1 holding the container with a lid 10 from the toilet paper holder 7.

As shown in FIG. 10, the support part 5 of the container holder 1 is inclined at an angle K to the back part 5 so as to extend away from a plane including the surface of the back part 5. Preferably, the angle K is in the range of 5° to 20°. In this embodiment shown in FIG. 10, K=15°.

Figure 9:
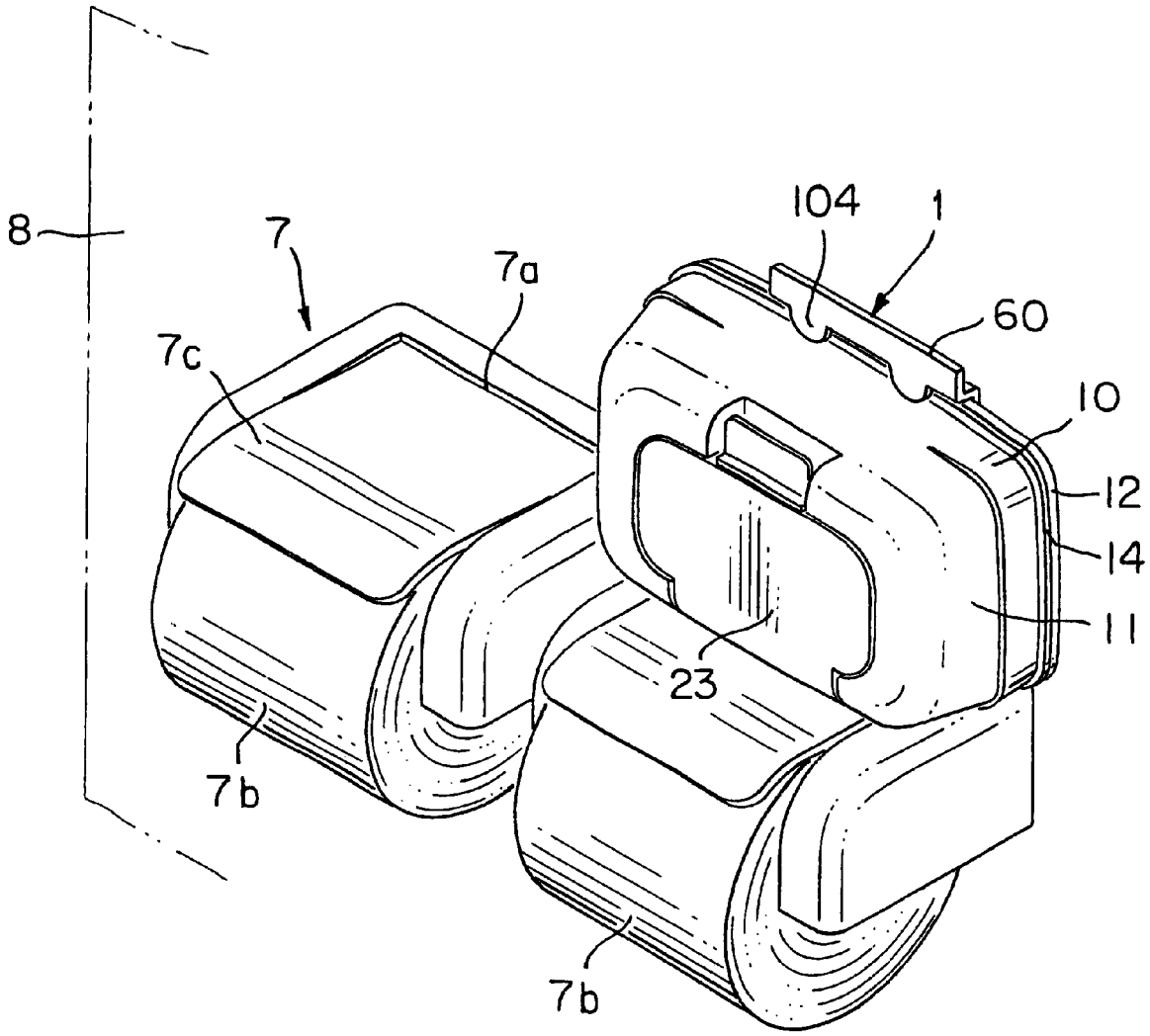
FIG. 9 is a perspective view showing the wet tissue container shown in FIG. 7 attached to a toilet paper holder.

As shown in FIG. 9, the toilet paper holder 7 holds a toilet paper roll 7*b* and is attached to a wall 8 of a toilet room. Since the support part 5 of the container holder 1 is inclined to the back part 2 of the same as mentioned above, the surface of the back part 2 is inclined to the wall 8 when the support part 5 is inserted in the slot 7*a* formed in the toilet paper holder 7 as shown in FIG. 10. Thus, the container with a lid 10 can be securely held by the container holder 1 having the back part 2 and the guide parts 103 and 104 on the wall 8 in an in an inclined position.

Operation of the second embodiment thus formed will be described hereinafter.

When holding the container with a lid 10 by the container holder 1, the opposite side edge parts 12*a* and 12*b* of the bottom wall 12 and the opposite side edge parts 14*a* and 14*b* of the flange 14 of the container body 11 are inserted in a space between the first guide parts 103 and the second guide parts 104 of the container holder 1 so that the opposite side edge parts 12*a* and 12*b* of the bottom wall 12 and the opposite side edge parts 14*a* and 14*b* of the flange 14 of the container body 11 engage the guide parts 3 and 4, respectively. The pair of edge parts 12*a* and 12*b* of the bottom wall 12 and the pair of edge parts 14*a* and 14*b* of the flange 14 can be easily brought into engagement with the first guide parts 103 and the second guide parts 104 by pressing the operating part 60 to bend the second guide parts 104. The container with a lid 10 can be easily positioned on the container holder 1 by bringing the pair of convex side parts 13*a* and 13*b* of the side wall 13 into engagement with the first guide parts 103 and the second guide parts 104, respectively.

Then, the support part 5 of the container holder 1 is inserted in the slot 7*a* of the toilet paper holder 7 to hold the container with a lid 10 securely on the toilet paper holder 7. In this state, the stopper ribs 6 formed on the back part 2 rest on the upper surface of the brim 62 of the slot 71 to hold the container holder 1 on the toilet paper holder 7 and the stopping part 5*a* of the support part 5 is positioned beneath the slot 7*a*.

When using wet tissues 41, a finger tab 88 formed on the horizontal wall 55*b* of an operating member 55 is depressed to disengage a stopping projection 32 and a catching projection 33. Then, a lid 23 is opened by the resilience of a rubber plate 50.

The top wet tissue 41 is picked up between fingers and is pulled up. Then the wet tissue 41 is pulled out of the container body 11 through an opening 24 formed in the container body 11. When the top wet tissue 41 is thus pulled out of the container body 11, the lower half 41*b* of the top wet tissue 41 pulls the upper half 4 la of the second top wet tissue 41 into the gap between the end edges of the first flaps 82 and those of the second flaps 83. After the top wet tissue 41 has been taken out, the upper half 41*a* of the second top wet tissue 41 is held between first flaps 82 and second flaps 83.

When removing the container with a lid 10 from the toilet paper holder 7 to replenish the container with a lid 10 with wet tissues 41, the operating part 60 is pressed to bend the second guide parts 104 so that the second guide parts 104 are disengaged from the edge part 12*b* of the bottom wall 12 and the edge part 14*b* of the flange 14. Thus, only the container with a lid 10 can be separated from the container holder 1 without removing the container holder 1 from the toilet paper holder 7.

In the second embodiment, the container with a lid 10 can be easily held on the wall of the toilet room by inserting the support part 5 of the container holder 1 holding the container with a lid 10 in the slot 7*a* of the toilet paper holder 7. The wet tissue 41 can be easily pulled out through the opening 24 by depressing the finger tab 88 to open the lid 23. When replenishing the container with a lid 10 with wet tissues 41, only the container with a lid 10 can be removed from the container holder 1 simply by bending the second guide parts 104.

Thus, according to the present invention, the container with a lid can be easily held on the toilet paper holder placed on the wall of the toilet room by the container holder. The lid can be easily opened and the contents of the container with a lid can be easily taken out. Only the container with a lid can be separated from the container holder without removing the container holder from the toilet paper holder.

Third Embodiment

A third embodiment of the present invention will be described with reference to FIGS. 1 to 15. Wet tissue containers (containers with a lid) and container holders shown in FIGS. 11 to 15 are modifications of the wet tissue container (container with a lid) 10 and the container holder 1 in the first embodiment shown in FIGS. 1 to 6.

Figure 11:
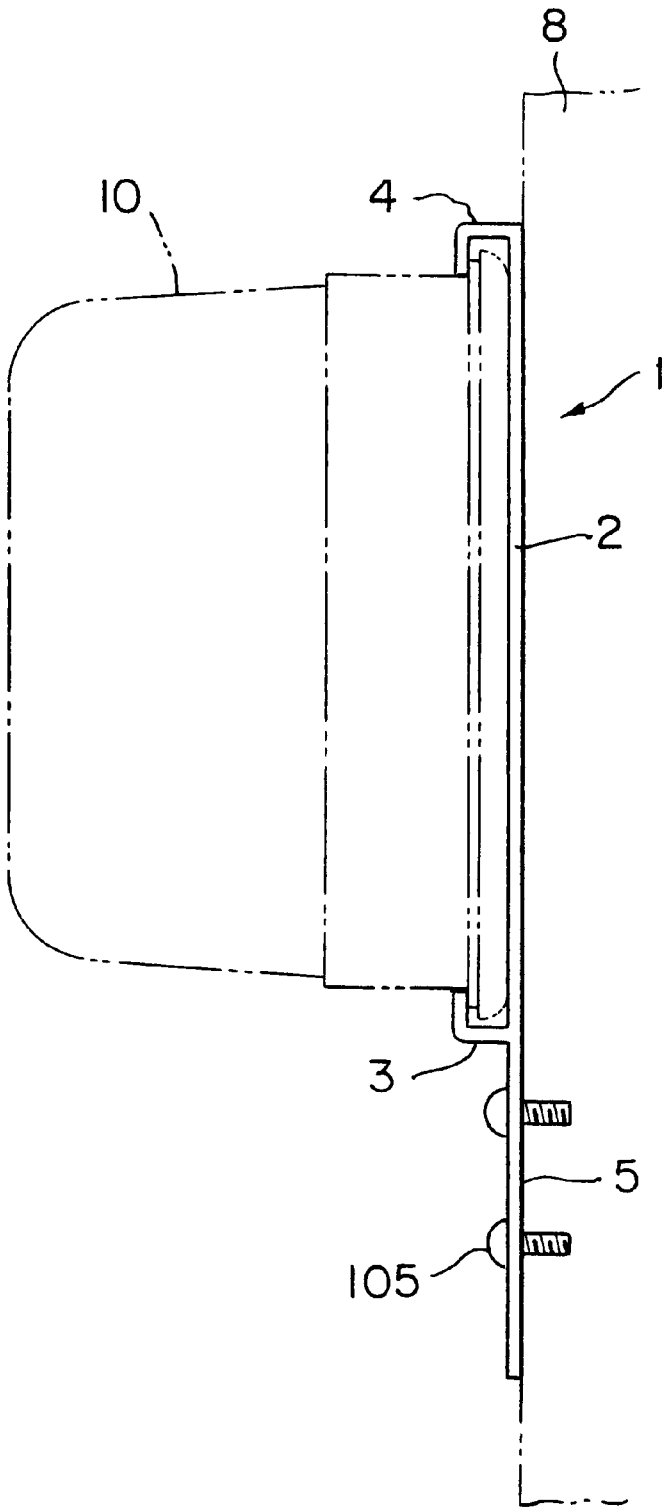
FIG. 11 is a side elevation view showing a modification of a container holder included in a third embodiment of the present invention.
Figure 12:
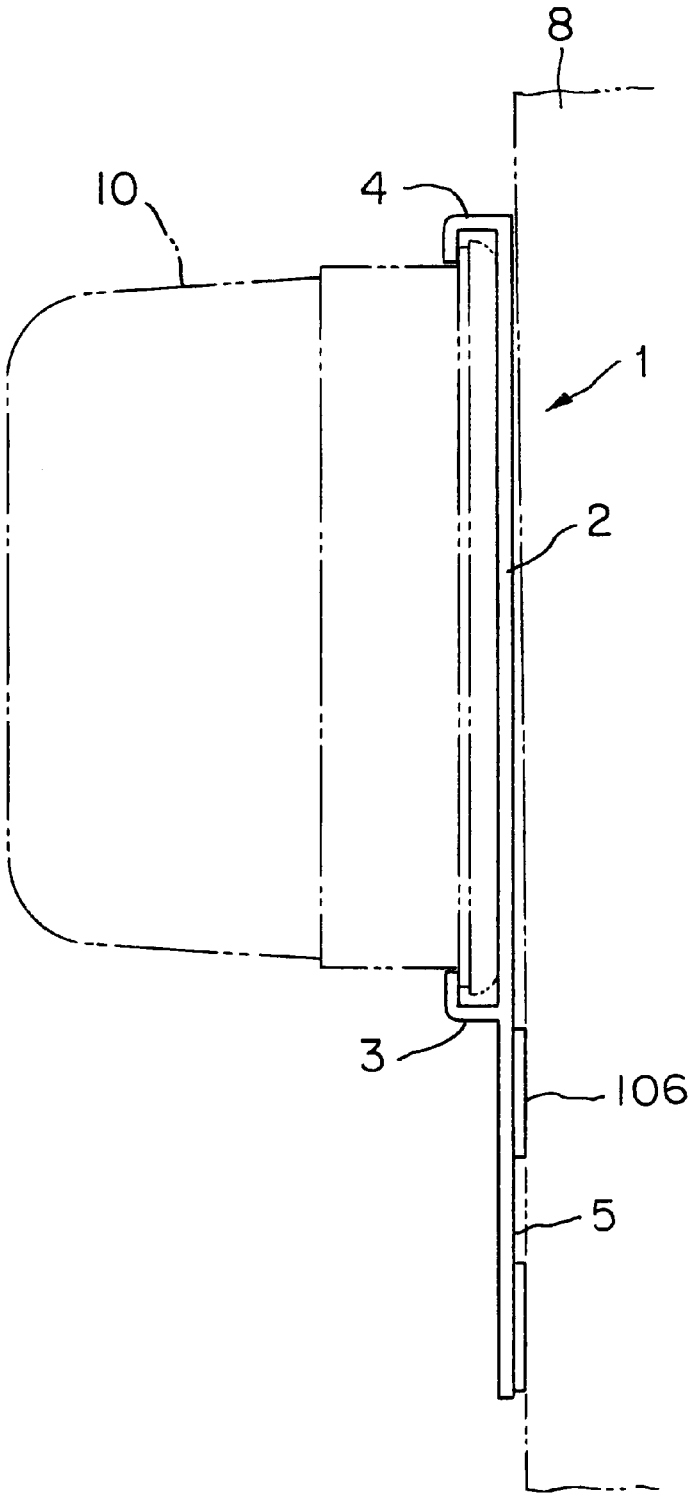
FIG. 12 is a side elevation showing a container holder in another modification.

The container holder 1 of the first embodiment shown in FIGS. 1 to 6 has the support part 5 inserted in the slot 7*a* of the toilet paper holder 7. The support part 5 of the container holder 1 may be fastened to a wall 8, i.e., a fixed structure, of a toilet room with screws 105 as shown in FIG. 11. The support part 5 of the container holder 1 may be bonded to a wall of a toilet room 8 with a pressure-sensitive adhesive double-coated tape 106 as shown in FIG. 12.

The back part 2 of the container holder 1 shown in FIG. 11 may be fastened to the wall 8 with screws 105. The back part 2 of the container holder 1 shown in FIG. 12 may be bonded to the wall 8 with a pressure-sensitive adhesive double-coated tape.

Figure 13:
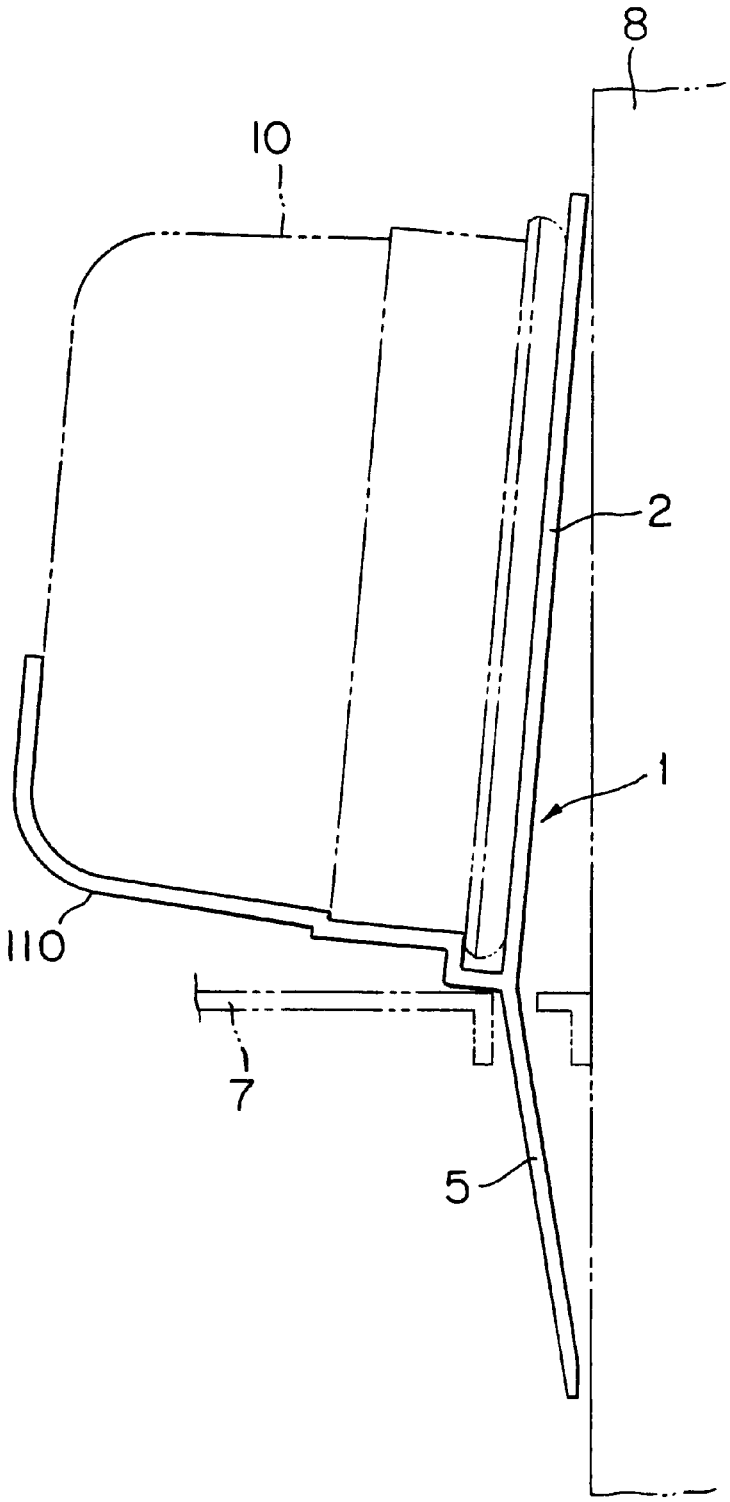
FIG. 13 is a side elevation showing a container holder in a third modification.

The container holder 1 of the first embodiment shown in FIGS. 1 to 6 holds the container with a lid 10 on the container holder 1 by the guide parts 3 and 4 having an L-shaped cross section. A container holder 1 as shown in FIG. 13 may be used for folding the container with a lid 10. The container holder 1 shown in FIG. 13 has a container support part 110. The container with a lid 10 is supported on the container support part 110 with its bottom surface pressed against a back part 2 of the container holder 1.

Figure 14:
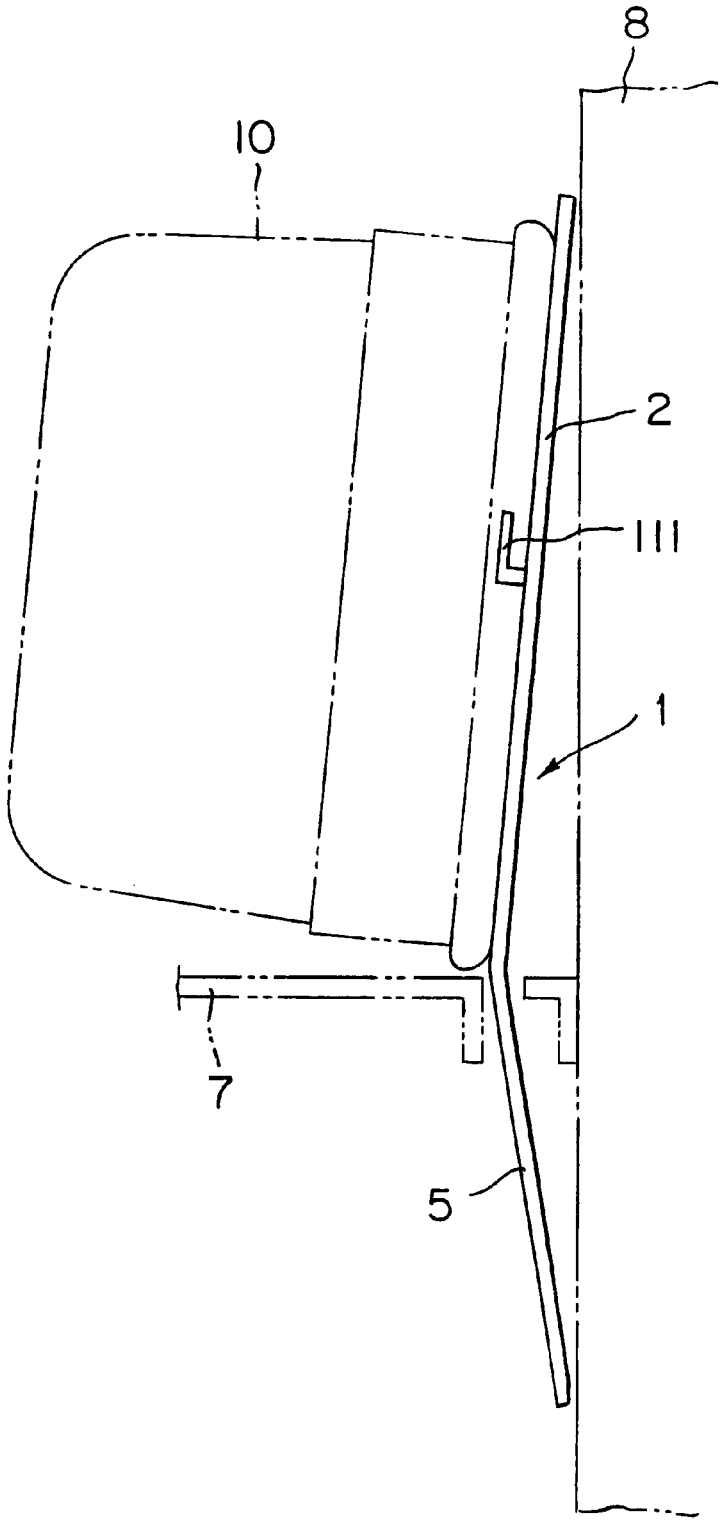
FIG. 14 is a side elevation showing a container holder in a fourth modification.

A container holder 1 as shown in FIG. 14 may be used for folding the container with a lid 10. The container holder 1 shown in FIG. 13 has a back part 2 provided with a hook 111. The container with a lid 10 is held in contact with the back part 2 of the container holder 1 with the hook 111 of the container holder 1 engaged in a hole, not shown, formed in the bottom wall of the container with a lid 10.

Figure 15:
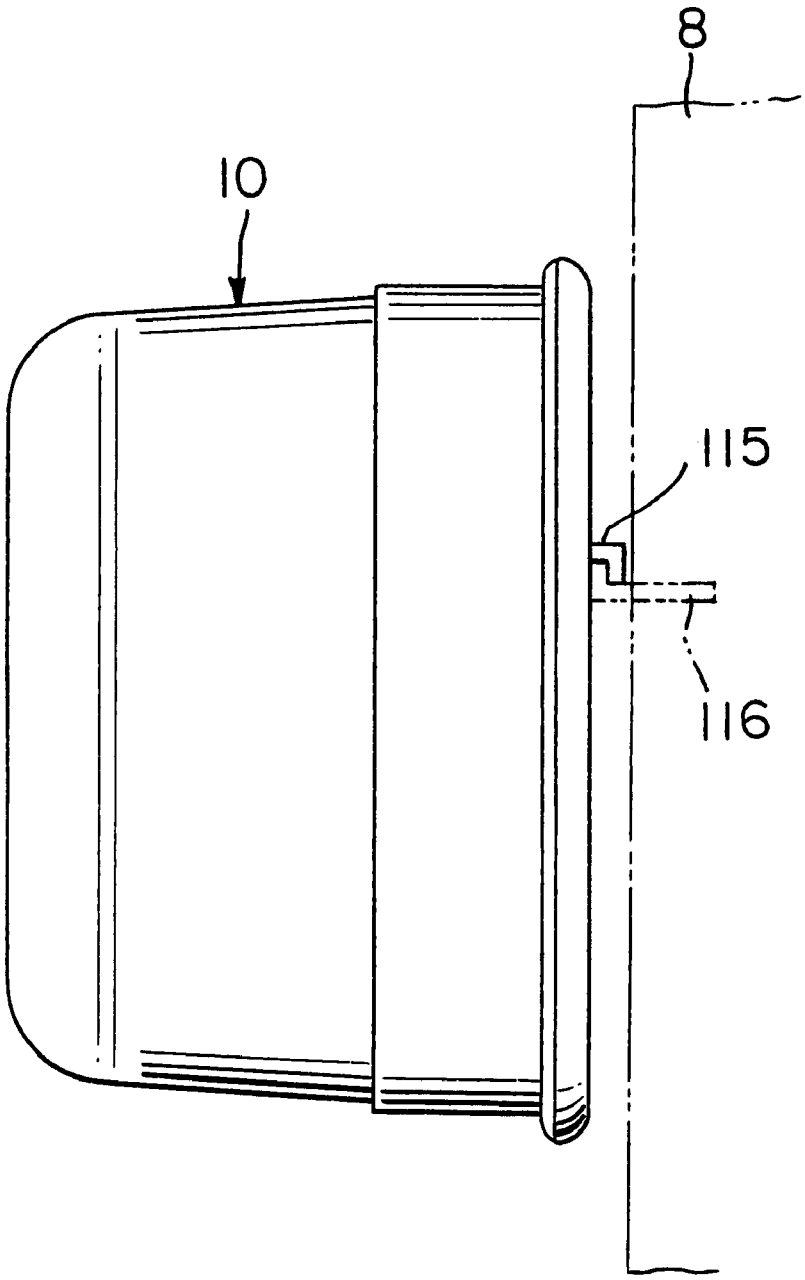
FIG. 15 is a side elevation showing a wet tissue container in a modification.

Although the first embodiment shown in FIGS. 1 to 6 is a combination of the wet tissue container (container with a lid) 10 and the container holder 1, the container with a lid 10 may be provided on its bottom surface with a hanging part 115 of an L-shaped cross section and the hanging part 115 may be engaged with a hook 116 fastened to the wall 8 to hang the container with a lid 10 on the wall 8 as shown in FIG. 15.

Figure 16:
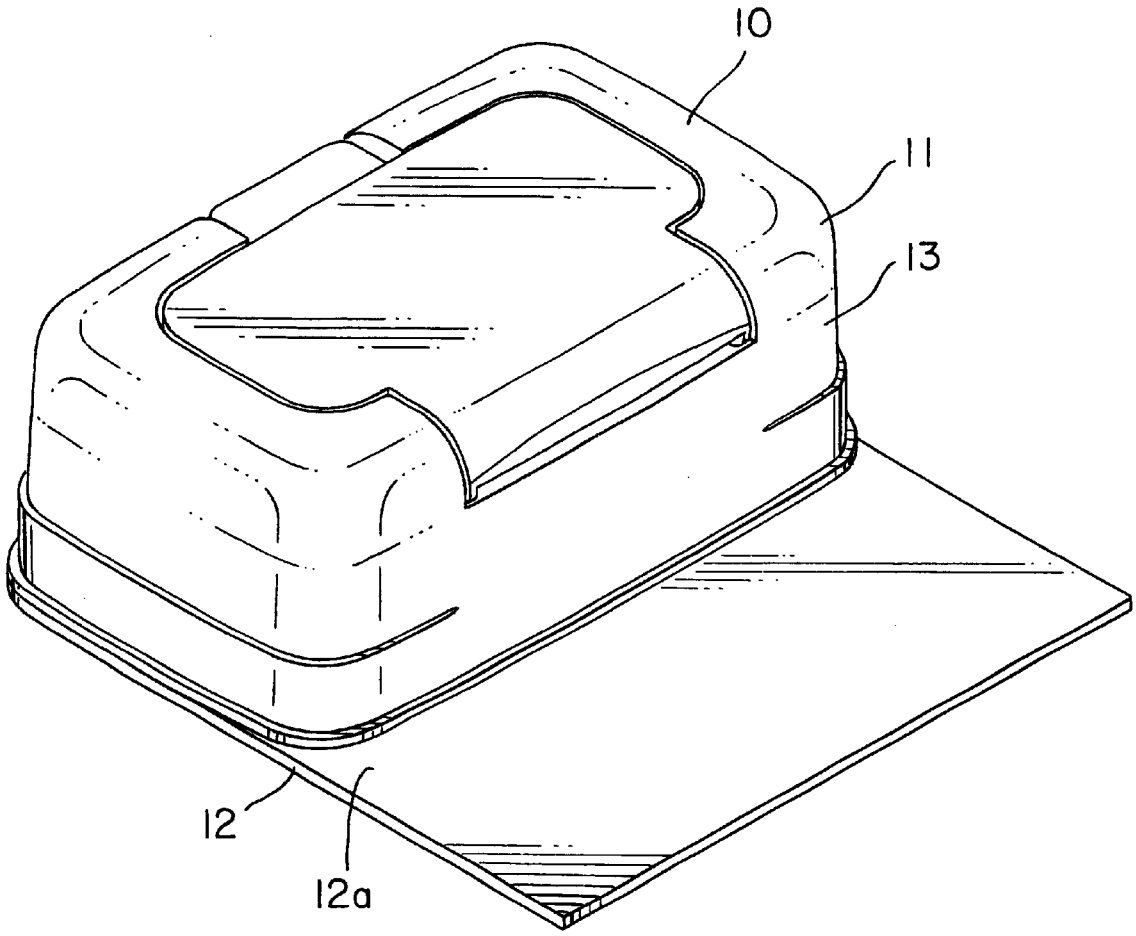
FIG. 16 is a respective view showing a wet tissue container in another modification.

The bottom wall 12 of the wet tissue container (container with a lid )10 may be provided integrally with an extension 12*a* extending outward from the container body 11 as shown in FIG. 16. The extension 12*a* may be inserted in the slot 7*a* of the toilet paper holder 7 to hold the container with a lid 10 on the toilet paper holder 7 without using any member like the container holder 1.

The extension 12*a* of the bottom wall 12 may be fastened to the wall 8 with screws 105 as shown in FIG. 11 or the same may be bonded to the wall 8 with a pressure-sensitive adhesive double-coated tape 106 as shown in FIG. 12.

The modifications of the first embodiment shown in FIGS. 1 to 6 shown in FIGS. 11 to 15 may be applied to the second embodiment shown in FIGS. 7 to 10.

Although the toilet paper holder 7 provided with the slot 7*a* and the wall 8 of the toilet room has been mentioned by way of example as the fixed structure for holding the container with a lid 10, the container with a lid 10 may be held on any suitable structure other than that mentioned above, such as a water tank installed in the toilet room or a fixed structure in a room other than the toilet room.

Although the container with a lid has been described as applied to a wet tissue container, any suitable container, such as a paper box or a plastic bag, may be used provided that the container is capable containing wet tissues.

As is apparent from the foregoing description, the wet tissue container according to the present invention can be easily and simply held on a fixed structure in a room, such as a toilet room.

What is claimed is:

1. A combination of a wet tissue container and a container holder comprising:

a wet tissue container with opposite convex side parts; and a container holder capable of holding the wet tissue container on a fixed structure in a room, wherein the container holder has a holding structure capable of holding the wet tissue container so that the wet tissue container can be removed from the container holds, and wherein the holding structure of the container holder includes a back part with which a bottom wall of the wet tissue container comes into contact, a first guide part that engages one of the opposite convex side parts of the wet tissue container, and a second guide part that engages the other edge of the opposite convex side parts of the wet tissue container so that the wet tissue container can be positioned by sliding the wet tissue container along the first and second guide parts; and at least either the first guide part or the second guide part can be bent relative to the back part, each of said first and second guide parts being respectively connected to said back part solely by a single axis of connection, such that said bending will occur substantially solely along a one of said axes of connection.

2. The combination according to claim 1, wherein the container holder is fastened to the fixed structure with a screw.

3. The combination according to claim 1, wherein the container holder is bonded to the fixed structure with a adhesive double-coated tape.

4. The combination according to claim 1, wherein the container holder is inserted in the fixed structure.

5. The combination according to claim 4, wherein the fixed structure is a toilet paper holder provided with a slot, and the container holder is inserted in the slot of the toilet paper holder.

6. The combination according to claim 1, wherein the container holder is provided with a hook to support the wet tissue container thereon.

7. The combination according to claim 1, wherein the container holder has a container support part for supporting the wet tissue container thereon.

8. The combination according to claim 1, wherein the holding structure of the container holder includes guide parts of an L-shaped cross section that engage edge parts of the bottom wall of the wet tissue container.

9. The combination according to claim 8, wherein a pair of opposite side parts of a side wall of the wet tissue container are bulged convexly, the pair of opposite side parts are in contact with the guide parts of an L-shaped cross section, respectively, and sections of the guide parts in contact with the convex side parts of the side wall of the wet tissue container are curved concavely so as to conform to the convex side parts of the side wall of the wet tissue container.

10. The combination according to claim 8, wherein the container holder has a support part extending from the back part, and the support part is inclined at an angle to the back part so that the wet tissue container can extend away from a plane including a surface of the back part.

11. The combination according to claim 1, wherein the guide part capable of bending relative to the back part is formed of a soft resin.

12. The combination according to claim 1, wherein the guide parts capable of bending are connected through elastic members to the back part.

13. The combination according to claim 1, wherein the container holder has a support part connected to a back part, the support part is inserted in a slot formed in a toilet paper holder, and the support part is provided with a stopping part that engages a lower surface of a brim of the slot of the toilet paper holder.

14. The combination according to claim 1, wherein the back part is provided with a stopper rib that comes into contact with an upper surface of a brim of the slot of the toilet paper holder.

15. The combination according to claim 1, wherein the wet tissue container comprises: a container body with an open lower end including a top wall provided with an opening, and a side wall extending down from the top wall; a lid supported for turning on the container body and capable of hermetically closing the opening of the top wall; a bottom wall hermetically closing the open lower end of the container body; and an elastic biasing member interposed between the container body and the lid to bias the lid in an opening direction.

16. A combination of a wet tissue container and a container holder comprising:

a wet tissue container with opposite convex side parts; and a container holder capable of holding the wet tissue container on a fixed structure in a room, wherein (1) the container holder has a holding structure capable of holding the wet tissue container so that the wet tissue container can be removed from the container holder;

(2) the holding structure of the container holder includes a aback part with which a bottom wall of the wet tissue container comes into contact, a first guide part of an L-shaped cross section that engages one of the opposite convex side parts of the wet tissue container, and a second guide part of an L-shaped cross section that engages the other edge of the opposite convex side parts of the wet tissue container so that the wet tissue container can be positioned by sliding the wet tissue container along the first and second guide parts;

(3) a pair of opposite side parts of a side wall of the wet tissue container are bulged convexly, the pair of opposite side parts being in contact with the guide parts of an L-shaped cross section, respectively, and sections of the guide parts in contact with the convex side parts of the side wall of the wet tissue container are curved concavely so as to conform to the convex side parts of the side wall of the wet tissue container; and (4) each of said first and second guide parts are respectively connected to said back part solely by a single axis of connection, such that bending will occur substantially solely along a one of said axes of connection.

* * * * *